US008552324B2

(12) United States Patent
Kim et al.

(10) Patent No.: US 8,552,324 B2
(45) Date of Patent: Oct. 8, 2013

(54) LEVER BUTTON AND ELECTRONIC DEVICE THEREWITH

(75) Inventors: Shi-hyun Kim, Suwon-si (KR); Jong-sub Lee, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 337 days.

(21) Appl. No.: 13/012,938

(22) Filed: Jan. 25, 2011

(65) Prior Publication Data

US 2011/0220481 A1 Sep. 15, 2011

(30) Foreign Application Priority Data

Mar. 11, 2010 (KR) ..... 10-2010-0021845

(51) Int. Cl.
*H01H 21/00* (2006.01)

(52) U.S. Cl.
USPC ..... 200/553

(58) Field of Classification Search
USPC ..... 200/553, 332, 5 A, 275, 340, 341, 342, 200/343, 344, 461, 512
See application file for complete search history.

(56) References Cited

U.S. PATENT DOCUMENTS

| | | | | |
|---|---|---|---|---|
| 3,800,104 | A * | 3/1974 | Lien et al. | 200/5 A |
| 4,090,229 | A * | 5/1978 | Cencel et al. | 361/288 |
| 4,847,452 | A * | 7/1989 | Inaba | 200/5 A |
| 4,952,762 | A * | 8/1990 | Koyanagi | 200/517 |
| 7,994,443 | B2 * | 8/2011 | Hayashi et al. | 200/238 |
| 8,212,162 | B2 * | 7/2012 | Zhou | 200/5 A |

* cited by examiner

*Primary Examiner* — Edwin A. Leon
(74) *Attorney, Agent, or Firm* — Drinker Biddle & Reath LLP

(57) ABSTRACT

A lever button in which at least one side thereof is elastically supported and an electronic device therewith is provided. The lever button includes a manipulation part and an elastic part having one end supported by the manipulation part and another end supported by a support frame. The elastic part comprises at least one cantilever.

19 Claims, 5 Drawing Sheets

LEVER BUTTON AND ELECTRONIC DEVICE THEREWITH

CROSS-REFERENCE TO RELATED APPLICATION

This application claims the priority benefit of Korean Patent Application No. 10-2010-0021845, filed on Mar. 11, 2010, in the Korean Intellectual Property Office, the entire disclosure of which is incorporated herein by reference.

BACKGROUND

Embodiments relate to a lever button and an electronic device therewith, and more particularly, to a lever button in which a lever is operated to actuate a button to generate a signal and an electronic device therewith.

In general, electronic devices, such as digital image processing devices, can include devices that can process images, such as a digital camera, a personal digital assistant (PDA), a phone camera, a personal computer (PC) camera, and the like or that can utilize an image recognition sensor.

The electronic devices may include buttons to receive a user input. Lever type buttons that can be pushed may be used as the buttons.

In lever type buttons, when the lever is operated in one direction, a button disposed at one side may be pushed. Also, when the lever is operated in another direction, another button disposed at another side may be pushed.

A separate component for restoring the lever to its original position according to the operation directions of the lever may be required.

SUMMARY

Embodiments include a lever button in which at least one side thereof is elastically supported to realize a simple structure and an electronic device therewith.

According to an embodiment, a lever button includes: a manipulation part; and an elastic part having one end supported by the manipulation part and another end supported by a support frame, wherein the elastic part includes at least one cantilever.

The at least one cantilever may include a plastic material.

The elastic part may be integrated with the manipulation part.

The elastic part may include: a first elastic part including a first cantilever extending from the manipulation part in a first direction; and a second elastic part including a second cantilever extending from the manipulation part in a second direction.

The second direction may be opposite to the first direction.

The manipulation part may include a support shaft extending in a direction substantially perpendicular to a direction in which the elastic part extends to provide a rotation axis for the manipulation part.

The manipulation part may further include: a manipulation lever protruding from one surface to rotate the manipulation part with respect to the support shaft by manipulating the manipulation part; and a contact part protruding from a surface opposite to the one surface to operate a switch by manipulating the manipulation part.

The contact part may include: a first contact part disposed at a first position offset from the support shaft in a first direction; and a second contact part disposed at a second position offset from the support shaft in a second direction opposite to the first direction.

The elastic part may include: a fixed part having the one end related to the manipulation part and extending from the manipulation part in a first direction; an extension part extending from the fixed part in a direction different from the first direction; and a support part extending from the extension part in the first direction, the support part having the other end related to the support frame.

The support frame may include: a penetration part configured to allow a manipulation lever to penetrate from one surface of the support frame to another surface of the support frame; an elastic support part that supports the other end of the elastic part on the one surface; and a shaft support part that supports a support shaft that provides a rotation axis of the manipulation part on the one surface.

The elastic support part may include a groove in which the other end of the elastic part is inserted in the one surface in a third direction extending from the one surface to the other surface.

The shaft support part may include a groove in which the support shaft is fitted in a third direction extending from the one surface to the other surface.

The support shaft may be fitted into the shaft support part to allow the elastic part to be elastically biased in a fourth direction opposite to the third direction.

According to another embodiment, a lever button includes: a manipulation part; and an elastic part having one end integrally formed with the manipulation part and the other end elastically supported by a support frame.

According to another embodiment, an electronic device includes the lever button.

BRIEF DESCRIPTION OF THE DRAWINGS

Exemplary embodiments will be more clearly understood from the following detailed description taken in conjunction with the accompanying drawings in which.

DETAILED DESCRIPTION OF THE EMBODIMENTS

Exemplary embodiments will now be described more fully with reference to the accompanying drawings, in which the exemplary embodiments are shown.

Figure 1:
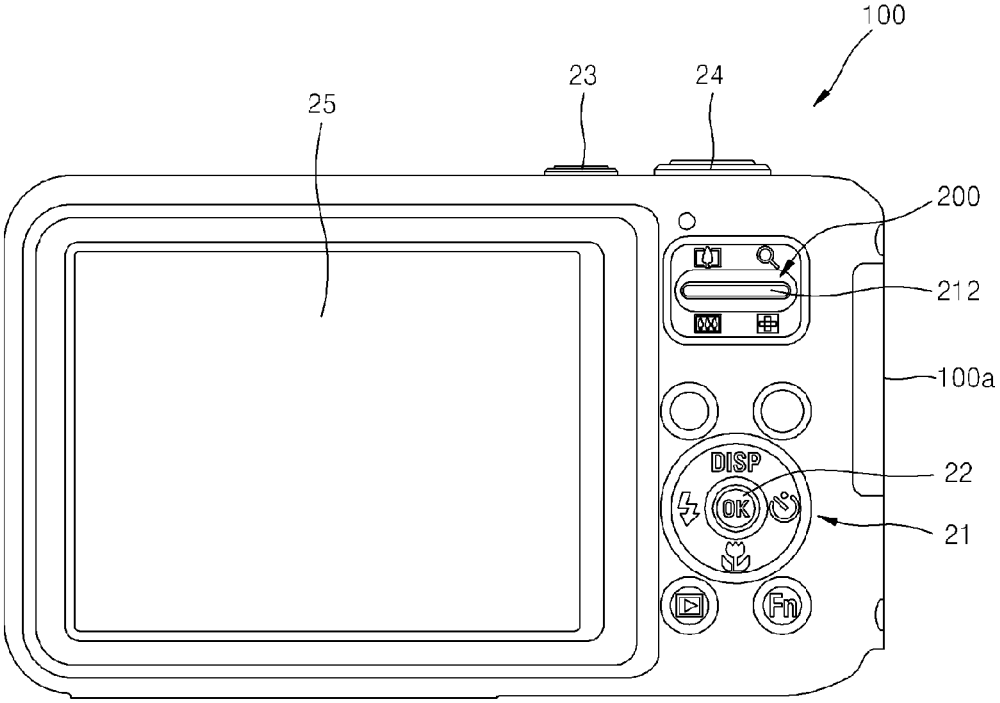
FIG. 1 is a schematic view illustrating an outer appearance of a back surface of a digital camera, according to an embodiment.

FIG. 1 is a schematic view illustrating an outer appearance of a back surface of a digital camera 100 according to an embodiment.

Referring to FIG. 1, navigation buttons 21, a menu-OK button 22, a display panel 25, and a lever button 200 may be disposed on the back surface of the digital camera 100.

The navigation buttons 21 may include four navigation buttons corresponding to up, down, left, and right directions. Special functions may be respectively assigned to the navigation buttons 21, and the assigned functions may be executed when selected. Various menus with respect to operations of a digital image processing device, such as the digital camera 100, may be executed by operating the navigation buttons 21 and the menu-OK button 22.

An image display device, such as a liquid crystal display (LCD), may be used as the display panel 25. A live view image may be displayed on the display panel 25, or a stored image may be reproduced and displayed on the display panel 25.

A power switch 23 and a shutter release button 24 may be disposed on a top surface of the digital camera 100. The power switch 23 may be used to turn on the digital camera 100 to operate the digital camera 100 or may be used to turn off the digital camera 100. The shutter release button 24 may be associated with an aperture (not shown) to properly expose a subject when recording an image in the digital camera 100.

The lever button 200 is a user input unit that may include a manipulation lever 212 that may be operated in an up or down and/or a left or right direction to receive a user input. That is, the lever button 200 may be vertically and/or horizontally operated. According to the present embodiment shown in FIG. 1, the lever button 200 may be vertically operated. When the lever button 200 is operated upward, a predetermined function may be selected. Also, when the lever button 200 is operated downward, another predetermined function may be selected.

The lever button 200 may be, for example, a button for selecting a wide-angle zoom function or a telephoto-zoom function. The lever button 200 may widen or narrow an angle of view according to how the lever button 200 is operated. In particular, the lever button 200 may be used to change a size of a selected exposure region.

In one embodiment, the lever button 200 may be operated upward to select the wide-angle zoom function, and the lever button 200 may be operated downward to select the telephoto-zoom function. When the lever button 200 is operated to select the wide-angle zoom function, the selected exposure region may increase in size. Also, when the lever button 200 is operated to select the telephoto-zoom function, the selected exposure region may decrease in size.

When the manipulation lever 212 of the lever button 200 is at a central portion, the lever button 200 may be in a neutral position state. An external force may be applied to operate the manipulation lever 212 upward. If the external force is removed, a restoring force that allows the manipulation lever 212 to move downward may act to restore the manipulation lever 212 to the neutral position. Also, an external force may be applied to operate the manipulation lever 212 downward. If the external force is removed, a restoring force that allows the manipulation lever 212 to move upward may act to restore the manipulation lever 212 to the neutral position.

An elastic member such as a rubber material or a spring may be used to provide the restoring force to the manipulation lever 212. However, when such an elastic member is used, the elastic member is a separate component that has to be added, and thus, an additional assembly process for adding the separate component has to be performed. In addition, an operational feel of the manipulation lever 212 may be different according to a configuration of the elastic member.

However, since the lever button 200 according to an embodiment uses a cantilever-shaped elastic member extending from the manipulation lever 212 and supported by a support frame 300, the elastic member may normally be maintained at the center portion of the lever button 200 and maintain the same up-and-down operational feel of the manipulation lever 212.

Figure 2:
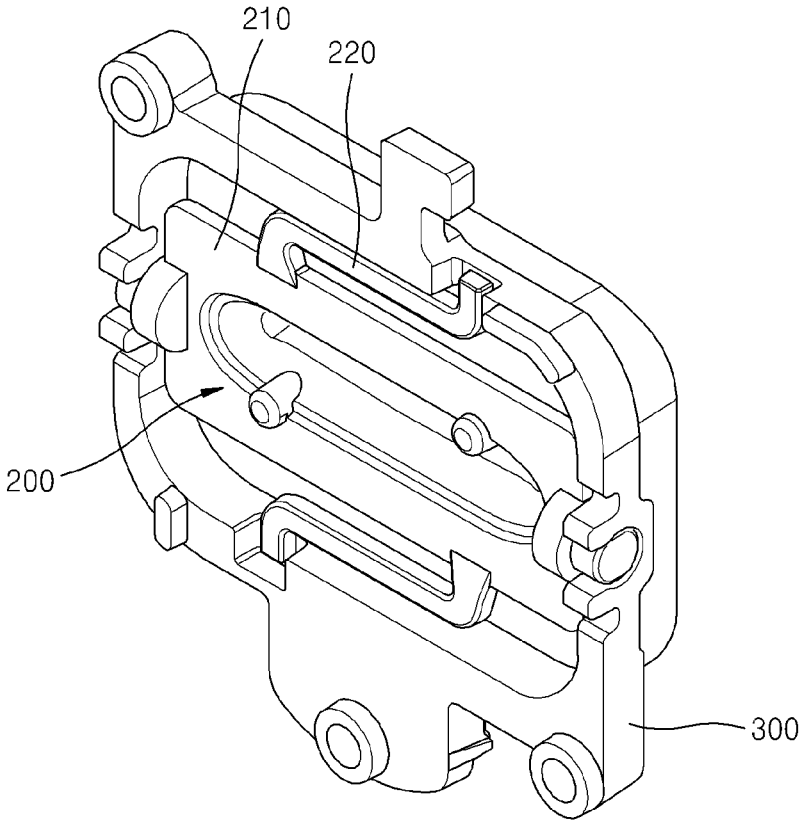
FIG. 2 is a perspective view of a support frame including a lever button, separated from a main body of the digital camera of FIG. 1, according to an embodiment.
Figure 3:
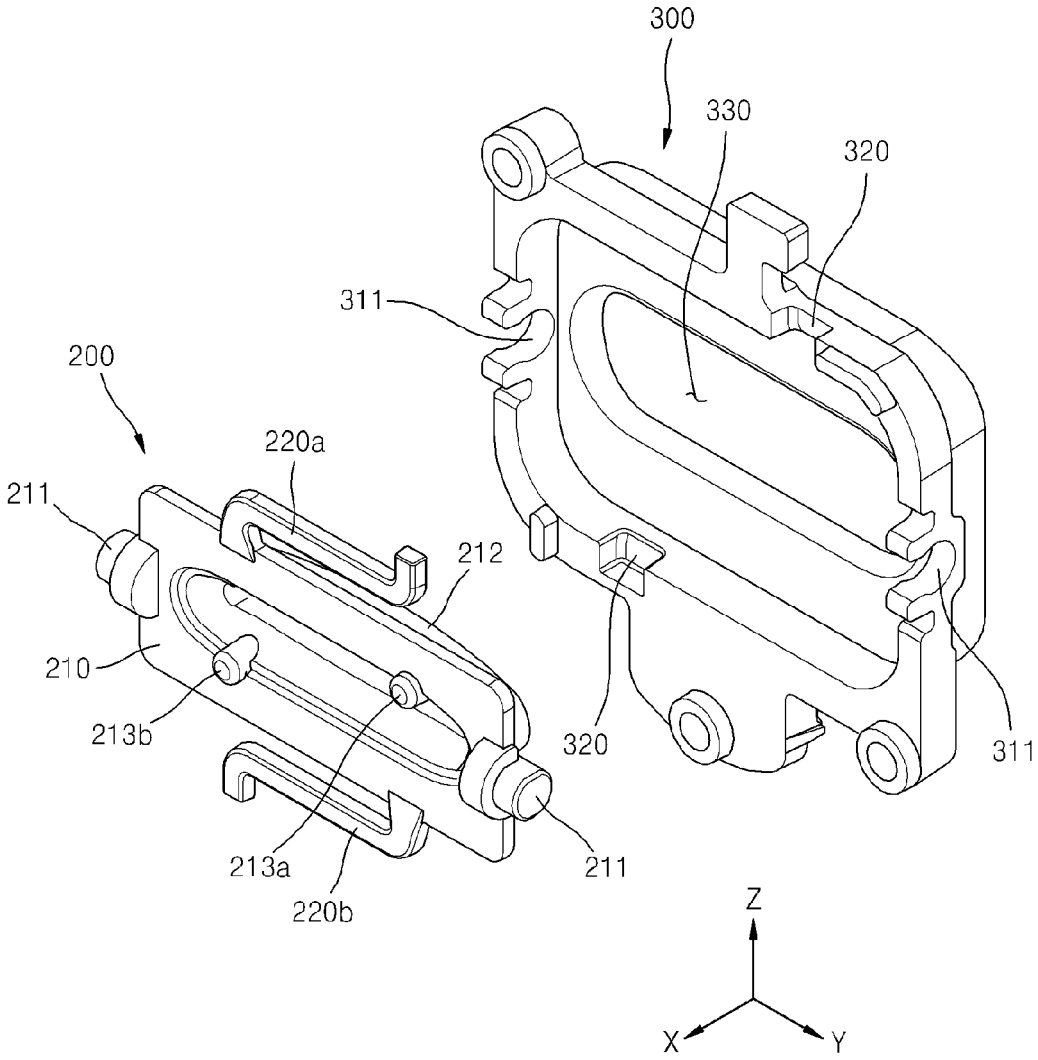
FIG. 3 is an exploded perspective view of the lever button and the support frame of FIG. 2, according to an embodiment.
Figure 4:
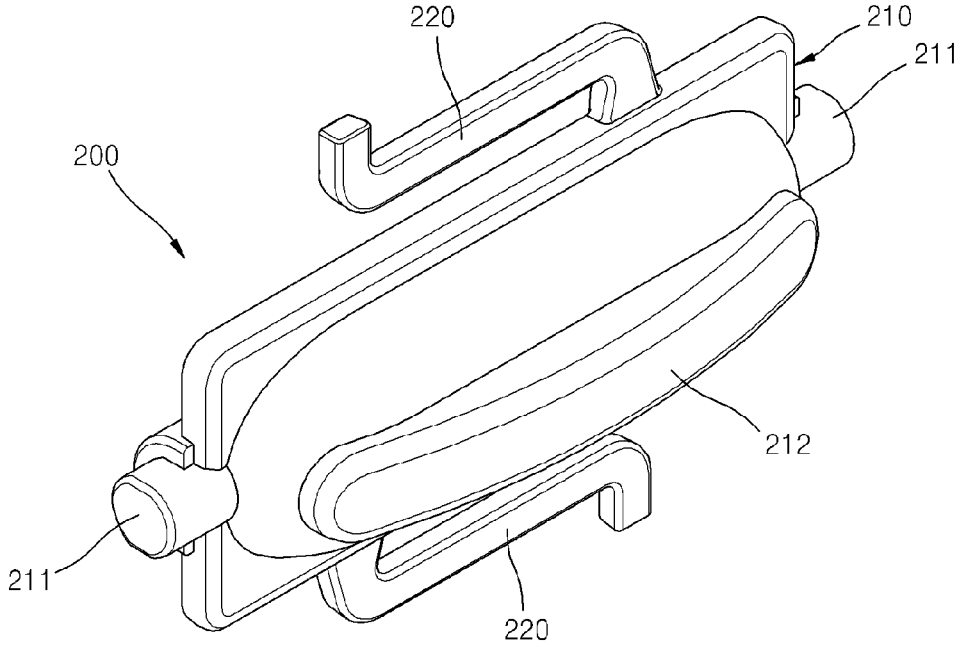
FIG. 4 is a schematic perspective view illustrating the lever button of FIG. 3, according to an embodiment.
Figure 5:
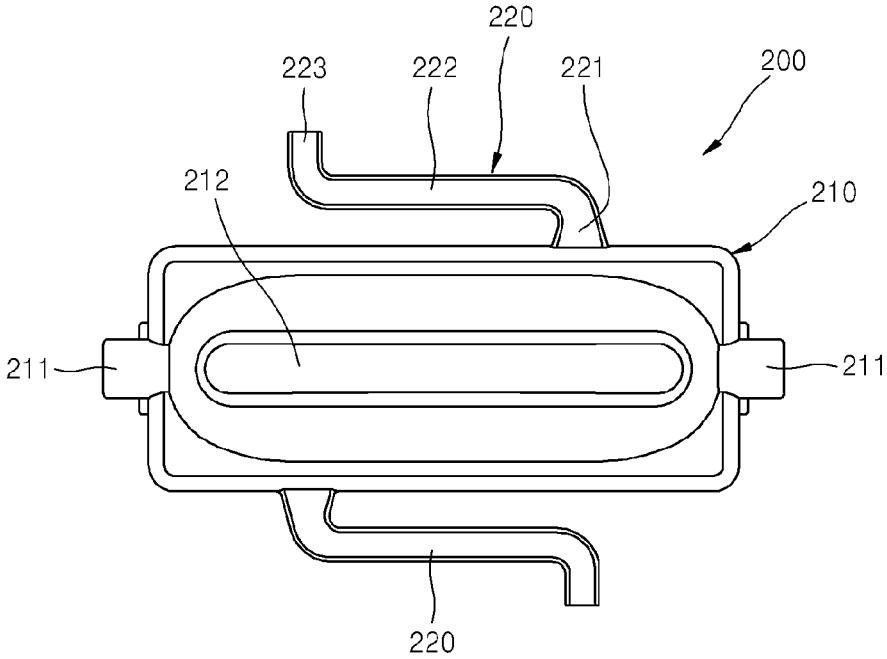
FIG. 5 is a front view illustrating the lever button of FIG. 3, according to an embodiment.

FIG. 2 is a perspective view of a support frame 300 including the lever button 200 and separated from a main body 100*a* in the digital camera 100 of FIG. 1, according to an embodiment. FIG. 3 is an exploded perspective view of the lever button 200 and the support frame 300, according to an embodiment. FIGS. 4 and 5 are views illustrating an outer appearance of a front surface of the lever button 200, according to embodiments.

Referring to FIGS. 2 to 5, the lever button 200 includes a manipulation part 210 and an elastic part 220. The manipulation part 210 may be operated by receiving an external force from a user. The elastic part 220 has one end supported by the manipulation part 210 and another end supported by the support frame 300.

The elastic part 220 may include at least one elastic cantilever. That is, the elastic part 220 can have the one end integrally fixed to the manipulation part 210 and the other end elastically supported by the support frame 300.

The elastic part 220 may be formed of an elastic material and formed to a predetermined length. The cantilever of the elastic part 220 may be formed of a plastic material.

Thus, the elastic part 220 may provide a restoring force that restores the manipulation part 210 to a neutral position when the manipulation part 210 is not operated. In the embodiment shown, since the elastic part 220 and the manipulation part 210 are integrated with each other to provide the restoring force, the lever button 200 is realized as having a simple structure. Thus, assemblability may be improved, and part prices may be reduced.

The plastic material may be a high molecular compound deformable by applying heat and pressure. The elastic part 220 may be formed of at least one of polyethylene (PE), polypropylene (PP), polystyrene (PS), polyethylene terephthalate (PET), polyamides (PA, e.g., nylon), polyester (PES), polyvinyl chloride (PVC), polyurethanes (PU), polycarbonate (PC), and polyvinylidene chloride (PVDC).

The lever button 200 shown in the drawings may be vertically operated to receive a user input. When the manipulation part 210 is operated upward or downward, the elasticity of the elastic part 220 may act on the manipulation part 210 as a restoring force in a direction opposite to the direction in which the manipulation part 210 is operated.

Referring to FIG. 3, the elastic part 220 may include a first elastic part 220*a* and a second elastic part 220*b*. The first elastic part 220*a* may be a cantilever extending from the manipulation part 210 in a Z-direction (shown in FIGS. 3 and 6) corresponding to a first direction, such as an upward direction. The second elastic part 220*b* may be a cantilever extending from the manipulation part 210 in a −Z-direction (shown in FIGS. 3 and 6) corresponding to a second direction, such as a downward direction. The first direction and the second direction may be opposite to each other.

Thus, when the manipulation part 210 is operated in the upward direction or the Z-direction, the restoring force may act in the downward direction or the −Z-direction. Also, when the manipulation part 210 is operated in the downward direction or the −Z-direction, the restoring force may act in the upward direction or the Z-direction.

It may be necessary to restrict the movement of the manipulation part 210 when operating the manipulation part 210 in the upward or downward direction. Thus, the manipulation part 210 may include a support shaft 211 that serves as a rotation axis of the manipulation part 210. The support shaft 211 may be restricted and supported by the support frame 300.

The support shaft 211 extends in a direction substantially perpendicular to a direction in which the elastic part 220 extends, e.g., a Y-direction (shown in FIG. 3), to serve as the rotation axis around which the manipulation part 210 rotates. The support shaft 211 can be fitted into the support frame 300 to restrict a translational motion of the manipulation part 210 while allowing a rotational motion of the manipulation part 210 centered about the rotation axis of the manipulation part 210.

Also, the manipulation part 210 may include a manipulation lever 212 and a contact part 213. Referring to FIG. 4, the manipulation lever 212 may protrude in a direction away from one surface of the manipulation part 210, e.g., in a −X-direction (shown in FIGS. 3 and 6). The manipulation lever 212 can be manipulated to rotate the manipulation part 210 with respect to the support shaft 211.

Returning to FIG. 3, the contact part 213 may protrude in a direction away from a surface opposite to the one surface of the manipulation part 210 from which protrudes the manipulation lever 212, e.g., in an X-direction (shown in FIGS. 3 and 6), to operate a switch (not shown) when the manipulation lever 212 is operated. For example, a switching device (not shown) may be disposed on the main body 100*a* at a position corresponding to the contact part 213 of the lever button 200.

The manipulation lever 212 may be operated to rotate the manipulation part 210 with respect to the support shaft 211, and the contact part 213 disposed on an inner surface of the manipulation part 210 may operate, for example by pushing, a switching device (not shown) disposed on the main body 100*a* to input a signal. When the manipulation lever 212 is vertically operated, the main body 100*a* of the electronic device may include switching devices that are separately operated or pushed according to whether the manipulation lever 212 is operated up or down.

The contact part 213 may include a first contact part 213*a* and a second contact part 213*b*. The first contact part 213*a* may be disposed at a position offset from the support shaft 211 in the first direction, for example, the upward direction or the Z-direction (shown in FIGS. 3 and 6). The second contact part 213*b* may be disposed at a position offset from the support shaft 211 in the second direction, for example, the downward direction or the −Z-direction (shown in FIGS. 3 and 6).

When the manipulation lever 212 is disposed at a central portion, the lever button 200 may be in a neural position state. If the manipulation lever 212 is operated upward by an external force, a restoring force may act downward on the manipulation lever 212 to restore the manipulation lever 212 to the neutral position. Also, if the manipulation lever 212 is operated downward by an external force, a restoring force may act upward on the manipulation lever 212 to restore the manipulation lever 212 to the neutral position.

It may be necessary for the elastic part 220 to have a predetermined length to allow the elastic part 220 to provide a sufficient elastic restoring force. Referring to FIG. 5, the elastic part 220 may thus include a fixed part 221, an extension part 222, and a support part 223.

Figure 6:
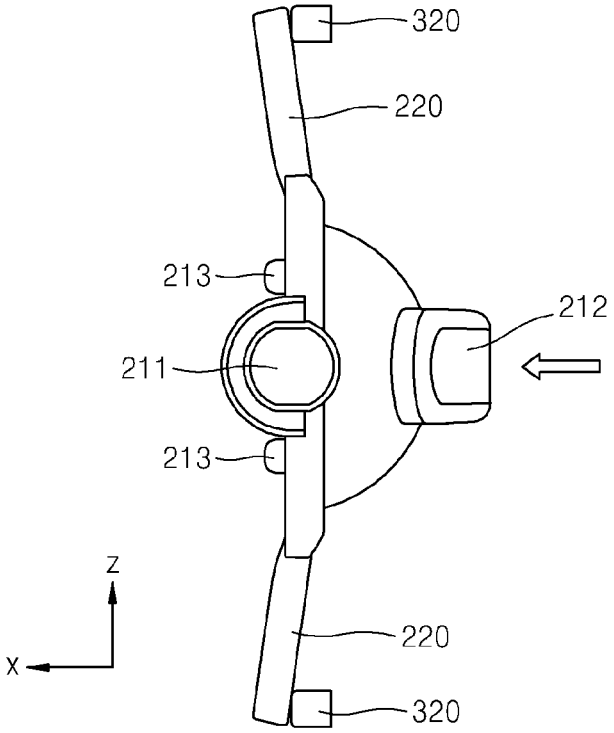
FIG. 6 is a side view illustrating the lever button of FIG. 3 supported by the support frame of FIG. 3, according to an embodiment.

The fixed part 221 can fix one end of the elastic part 220 to the manipulation part 210. The fixed part 221 can extend from the manipulation part 210 in the first direction, or the Z-direction as shown in FIGS. 3 and 6, or the second direction, −Z-direction as shown in FIGS. 3 and 6. The extension part 222 can extend from the fixed part 211 in a direction different from the first direction (or the Z-direction) or the second direction (or the −Z-direction), e.g., the Y-direction or a −Y-direction (as shown in FIG. 3). The support part 223 can extend from the extension part 222 in the first direction (or the Z-direction) or the second direction (or the −Z-direction). The support part 223 can have the other end of the elastic part 220 supported by the support frame 300.

The elastic part 220 may include the extension part 222 extending in a direction different to the direction in which the fixed part 221 extends from the manipulation part 210 to allow the manipulation part 210 to be supported by the support frame 300. Thus, the elastic part 220 may have a length sufficient to supply a sufficient amount of elastic force in a narrow space.

Turning to FIG. 3, the support frame 300 elastically supporting the lever button 200 may include a shaft support part 311, an elastic support part 320, and a penetration part 330.

The shaft support part 311 supports the support shaft 211 serving as the rotation axis of the manipulation part 210. The shaft support part 311 can be disposed on an inner surface of the support frame 300 facing the inside of the main body 100*a*. The elastic support part 320 can support the other end of the elastic part 220. The elastic support part 320 can be disposed on the inner surface of the support frame 300. The penetration part 330 is configured to allow the manipulation lever 212 to penetrate from the inner surface of the support frame 300 to an outer surface of the support frame 300.

The elastic support part 320 may include a groove in the inner surface of the support frame 300 in which the other end of the elastic part 220 can be inserted in a third direction, e.g., the −X-direction (shown in FIGS. 3 and 6). Thus, the elastic support part 320 may more stably support the support part 223 of the elastic part 220.

The shaft support part 311 may include a groove in which the support shaft 211 can be fitted into the inner surface of the support frame 300. For example, the support shaft can be fitted in the −X-direction. Thus, since the shaft support part 311 restricts the translational motion of the manipulation part 210 while allowing the rotational motion of the manipulation part 210 centered about the support shaft 211 of the manipulation part 210, the shaft support part 311 may more stably support the manipulation part 210.

The cantilever of the elastic part 220 may intentionally contact the support frame 300. Thus, the manipulation part 210 may be elastically supported by the support frame 300.

The manipulation lever 212 may be disposed at the neutral position in the state where the manipulation lever 212 is not operated. Since the support shaft 211 is fitted into the shaft support part 311, the elastic part 220 may be elastically biased in a fourth direction, e.g., the X-direction, opposite to the third direction, e.g., the −X-direction.

When the support shaft 211 is fitted into the support part 311, as shown in FIG. 6, the support part 223 of the elastic part 220 may be elastically supported by the elastic support part 320 to allow the other end of the elastic part 220 to contact the support frame 300. As a result, the elastic part 220 may be slightly bent.

Thus, the lever button 200 may be stably supported by the support frame 300 even through the manipulation lever 212 is in the neutral position state. Also, even when the manipulation lever 212 is operated upward or downward, the manipulation lever 212 may be stably restored to the neutral position. In addition, the manipulation lever 212 may maintain the same operational feel of the manipulation lever 212 during the up-and-down operation thereof, and the center of the manipulation lever 212 may be stably balanced.

According to an embodiment, since at least one side of the lever button is elastically supported, the lever button having a simple structure may be realized.

In the lever button according to an embodiment and the electronic device therewith, since at least one side of the lever button is elastically supported, the lever button having a simple structure may be realized.

All references, including publications, patent applications, and patents, cited herein are hereby incorporated by reference to the same extent as if each reference were individually and specifically indicated to be incorporated by reference and were set forth in its entirety herein.

For the purposes of promoting an understanding of the principles of the invention, reference has been made to the embodiments illustrated in the drawings, and specific language has been used to describe these embodiments. However, no limitation on the scope of the invention is intended by this specific language, and the invention should be construed to encompass all embodiments that would normally occur to one of ordinary skill in the art. The terminology used herein is for the purpose of describing the particular embodiments and is not intended to be limiting of exemplary embodiments of the invention.

The use of any and all examples, or exemplary language (e.g., "such as") provided herein, is intended merely to better illuminate the invention and does not pose a limitation on the scope of the invention unless otherwise claimed. Numerous modifications and adaptations will be readily apparent to those of ordinary skill in this art without departing from the spirit and scope of the invention as defined by the following claims. Therefore, the scope of the invention is defined not by the detailed description of the invention but by the following claims, and all differences within the scope will be construed as being included in the invention.

No item or component is essential to the practice of the invention unless the element is specifically described as "essential" or "critical." It will also be recognized that the terms "comprises," "comprising," "includes," "including," "has," and "having," as used herein, are specifically intended to be read as open-ended terms of art. The use of the terms "a" and "an" and "the" and similar references in the context of describing the invention (especially in the context of the following claims) are to be construed to cover both the singular and the plural, unless the context clearly indicates otherwise. In addition, it should be understood that although the terms "first," "second," etc. may be used herein to describe various elements, these elements should not be limited by these terms, which are only used to distinguish one element from another. Furthermore, recitation of ranges of values herein are merely intended to serve as a shorthand method of referring individually to each separate value falling within the range, unless otherwise indicated herein, and each separate value is incorporated into the specification as if it were individually recited herein.

What is claimed is:

1. A lever button comprising:

a manipulation part comprising a support shaft that provides a rotation axis for the manipulation part; and an elastic part having one end supported by the manipulation part and another end supported by a support frame, wherein the elastic part comprises at least one cantilever.

2. The lever button of claim 1, wherein the at least one cantilever comprises a plastic material.

3. The lever button of claim 1, wherein the elastic part is integrated with the manipulation part.

4. The lever button of claim 1, wherein the elastic part comprises:

a first elastic part including a first cantilever extending from the manipulation part in a first direction; and a second elastic part including a second cantilever extending from the manipulation part in a second direction.

5. The lever button of claim 4, wherein the second direction is opposite to the first direction.

6. The lever button of claim 1, wherein the manipulation part further comprises:

a manipulation lever protruding from one surface to rotate the manipulation part with respect to the support shaft by manipulating the manipulation part; and a contact part protruding from a surface opposite to the one surface to operate a switch by manipulating the manipulation part.

7. The lever button of claim 6, wherein the contact part comprises:

a first contact part disposed at a first position offset from the support shaft in a first direction; and a second contact part disposed at a second position offset from the support shaft in a second direction opposite to the first direction.

8. The lever button of claim 1, wherein the elastic part comprises:

a fixed part having the one end coupled to the manipulation part and extending from the manipulation part in a first direction;

an extension part extending from the fixed part in a direction different from the first direction; and a support part extending from the extension part in the first direction, the support part having the other end coupled to the support frame.

9. The lever button of claim 1, wherein the support frame comprises:

a penetration part configured to allow a manipulation lever to penetrate from one surface of the support frame to another surface of the support frame;

an elastic support part that supports the other end of the elastic part on the one surface; and a shaft support part that supports the support shaft that provides a rotation axis of the manipulation part on the one surface.

10. The lever button of claim 9, wherein the elastic support part comprises a groove into which the other end of the elastic part is inserted in the one surface in a third direction extending from the one surface to the other surface.

11. The lever button of claim 9, wherein the shaft support part comprises a groove into which the support shaft is fitted in a third direction extending from the one surface to the other surface.

12. The lever button of claim 11, wherein the support shaft is fitted into the shaft support part to allow the elastic part to be elastically biased in a fourth direction opposite to the third direction.

13. A lever button comprising:

a manipulation part comprising a support shaft that provides a rotation axis for the manipulation part; and an elastic part having one end integrally formed with the manipulation part and the other end elastically supported by a support frame.

14. An electronic device comprising:

a manipulation part comprising a support shaft that provides a rotation axis for the manipulation part; and an elastic part having one end supported by the manipulation part and another end supported by a support frame, wherein the elastic part comprises at least one cantilever.

15. The electronic device of claim 14, wherein the at least one cantilever comprises a plastic material.

16. The electronic device of claim 14, wherein the elastic part is integrally formed with the manipulation part.

17. The electronic device of claim of 14, wherein the elastic part comprises:

a first elastic part including a first cantilever extending from the manipulation part in a first direction; and a second elastic part including a second cantilever extending from the manipulation part in a second direction.

18. The electronic device of claim 14, wherein the elastic part comprises:

a fixed part having the one end coupled to the manipulation part and extending from the manipulation part in a first direction;

an extension part extending from the fixed part in a direction different from the first direction; and a support part extending from the extension part in the first direction, the support part having the other end coupled to the support frame.

19. An electronic device comprising:

a manipulation part comprising a support shaft that provides a rotation axis for the manipulation part; and an elastic part having one end integrally formed with the manipulation part and the other elastically supported by a support frame.

* * * * *